United States Patent [19]

Witchger

[11] 4,291,292

[45] Sep. 22, 1981

[54] ELECTRIC COIL LEAD ATTACHMENT MEANS AND METHOD

[76] Inventor: William J. Witchger, 4241 Kessler Lane East Dr., Indianapolis, Ind. 46220

[21] Appl. No.: 40,555

[22] Filed: May 21, 1979

[51] Int. Cl.[3] ..... H01F 15/10

[52] U.S. Cl. ..... 336/192; 336/209

[58] Field of Search ..... 336/192, 209; 174/40 CC; 24/16 PB; 248/74 PB

[56] References Cited

U.S. PATENT DOCUMENTS

| | | | |
|---|---|---|---|
| 2,961,785 | 11/1960 | Toepfer | 24/16 PB |
| 3,197,830 | 8/1965 | Hoadley | 24/16 PB |
| 3,913,179 | 10/1975 | Rhee | 24/16 PB |

FOREIGN PATENT DOCUMENTS

| | | | |
|---|---|---|---|
| 230292 | 11/1958 | Australia | 24/16 PB |
| 27923 | 7/1956 | Fed. Rep. of Germany | 336/209 |
| 67926 | 3/1958 | France | 174/40 CC |
| 1207065 | 2/1960 | France | 174/40 CC |
| 259578 | 6/1949 | Switzerland | 24/16 PB |
| 360840 | 4/1962 | Switzerland | 24/16 PB |

*Primary Examiner*—Thomas J. Kozma

*Attorney, Agent, or Firm*—Woodard, Weikart, Emhardt & Naughton

[57] ABSTRACT

Attachment of external electric supply lead wires to an electromagnetic coil assembly is done by a method using a harness base strip of resilient plastic insulating material having the two leads attached to the strip and the strip formed with a point and latching aperture portion for snapping onto the coil. The leads are twisted to the coil wire ends, soldered and laid flat against the outer face of the strip. A tailend portion of the strip is then wrapped over the soldered joints with subsequent taping, if desired.

9 Claims, 16 Drawing Figures

PRIOR ART

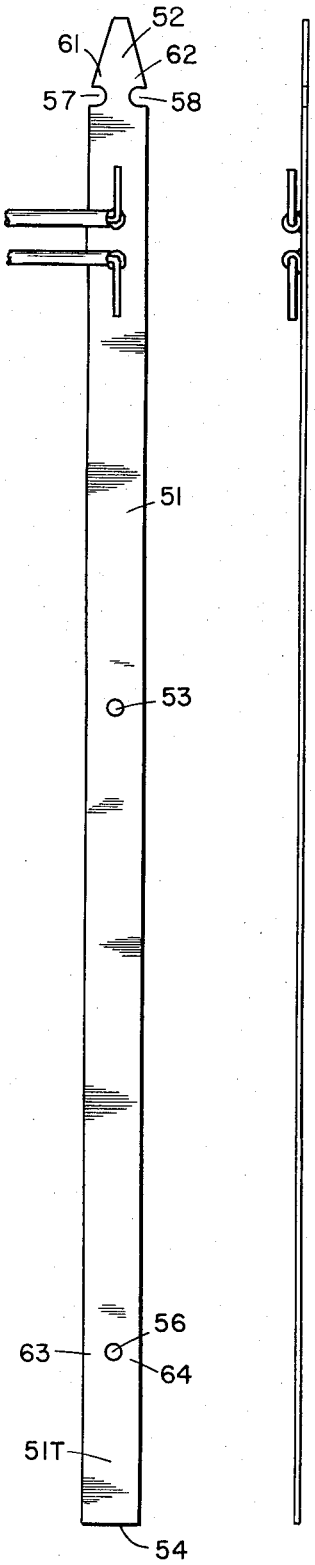
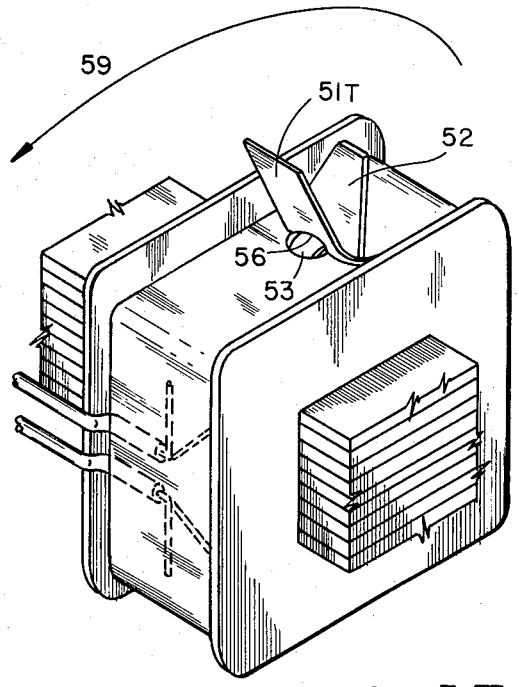
Fig.15
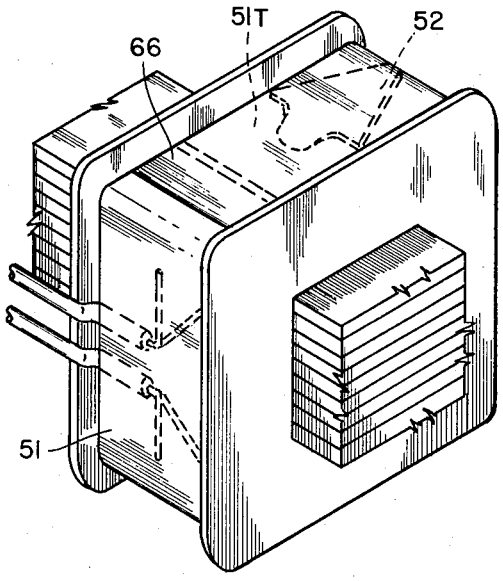
Fig.16
Fig.13 Fig.14

ELECTRIC COIL LEAD ATTACHMENT MEANS AND METHOD

BACKGROUND OF THE INVENTION

1. Field of the Invention

This invention relates generally to the manufacture of electric coils, and more particularly to means and a method of attaching external current supply leads to an electrical coil.

2. Description of the Prior Art

Manufacturers of electrical coils which employ many turns of fine wire, use some means of supplying a current to the wire from some source outside the coil. This usually involves a pair of electrical leads of insulated wire considerably heavier than the coil winding wire. These are attached to a harness which is taped to the coil. Then the coil winding wires are wound on the leads, and the leads are dipped in a solder pot or the like. Then the assembly is taped for secure attachment of the leads to the coil assembly, and also for protection of the solder connections. While it is a comparatively simple procedure, it does involve time and labor and contributes to the cost of coils, many of which are employed on devices which must be sold at a comparatively low price, in order to be competitive in the marketplace. The present invention is directed toward attachment of leads to a coil in a more convenient and better functioning way.

BRIEF SUMMARY OF THE INVENTION

Described briefly, in a typical embodiment of the present invention, current supply leads are attached to a single strip of a dielectric material strip conveniently attachable to a coil without use of adhesive, whereupon the coil winding wires are dip soldered to the lead conductors, followed by a quick cover by a tailend portion of the strip.

BRIEF DESCRIPTION OF THE DRAWINGS

FIG. 13 is a face view of a second embodiment of a harness device of the present invention.

FIG. 14 is an edge view thereof.

FIG. 15 is a perspective view showing a step in the procedure using the second embodiment.

FIG. 16 is a perspective view showing a further step in the procedure using the second embodiment.

DETAILED DESCRIPTION OF PRIOR ART

Figure 1:
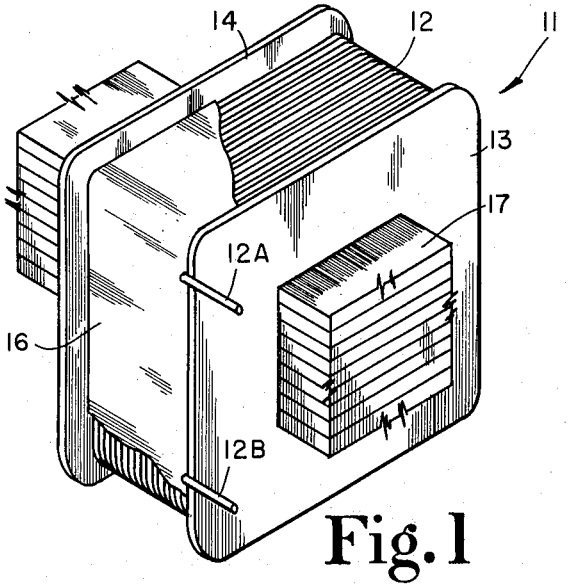
FIG. 1 is a perspective view of a portion of an electromagnetic coil assembled according to prior art techniques.

Referring now to the drawings in detail, FIG. 1 shows an electrical coil assembly 11 including many turns 12 of fine wire wound on a spool or bobbin having the shoulders 13 and 14 confining the wire coil between them. The ends of the wire are shown at 12A and 12B and a strip of tape 16 encircles the winding to keep the wire from unravelling. The tape is broken away to show the wire turns themselves, but should be understood to be conventionally applied completely around the winding for at least 360°. This coil assembly is mounted on a laminated ferromagnetic core 17.

Figure 2:
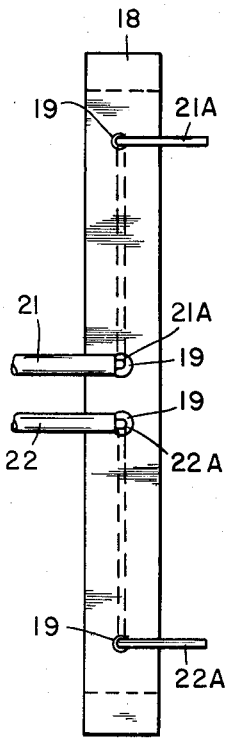
FIG. 2 is a face view of a prior art harness.
Figure 3:
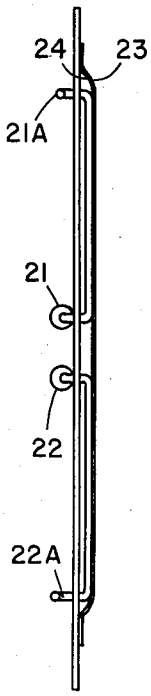
FIG. 3 is an edge view of a prior art harness.

The supply electrical energy to the winding, one prior art technique is to use a harness such as shown in FIGS. 2 and 3. This harness includes a strip 18 of some dielectric material such "Mylar" sheet having four apertures 19 therein. Insulated electric supply leads 21 and 22 have the conductors 21A and 22A thereof passed downwardly through the closely spaced apertures on the strip and under the strip and back up through the end apertures. These wires are secured to the strip by a piece of tape 23 which may be a "Mylar-rope" fiber tape having a pressure sensitive adhesive on the surface 24 thereof attached to the back of the Mylar strip 18 and thereby securing the lead wires to the back of the tape. The result is a harness assembly useful for attaching the leads 21 and 22 to the coil assembly of FIG. 1.

Figure 4:
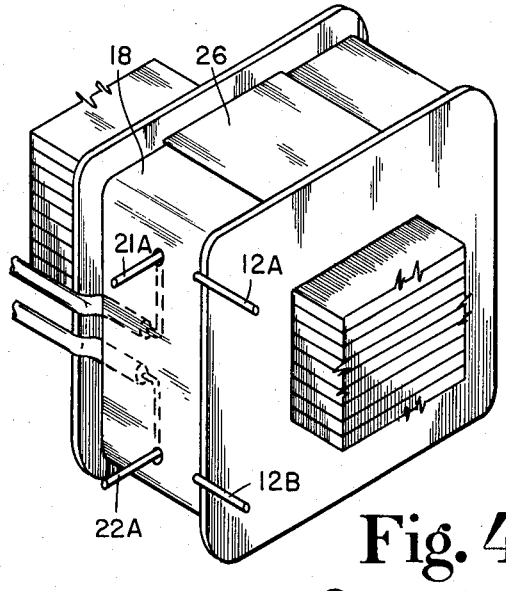
FIG. 4 is a perspective view showing a step in the prior art procedure of installing the harness to the coil.

The next step in the prior art procedure is to mount the tape 18 to the coil assembly. This may typically be done by wrapping the tape 18 onto the top of the tape 16 and then attaching the opposite ends of strip 18 to the tape 16 by short lengths of tape such as the adhesive tape 26 in FIG. 4. Alternatively, the tape 26 may be a single piece extending around the opposite side of the coil assembly and attached thereby to both ends of the strip 18 to secure it to the coil assembly.

Figure 5:
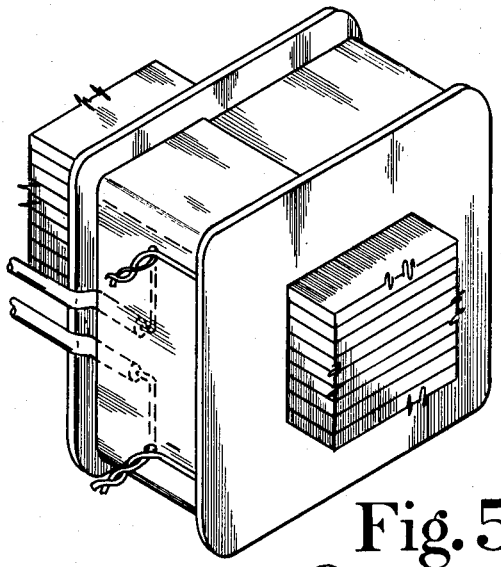
FIG. 5 is a perspective view showing a further step in procedure.
Figure 6:
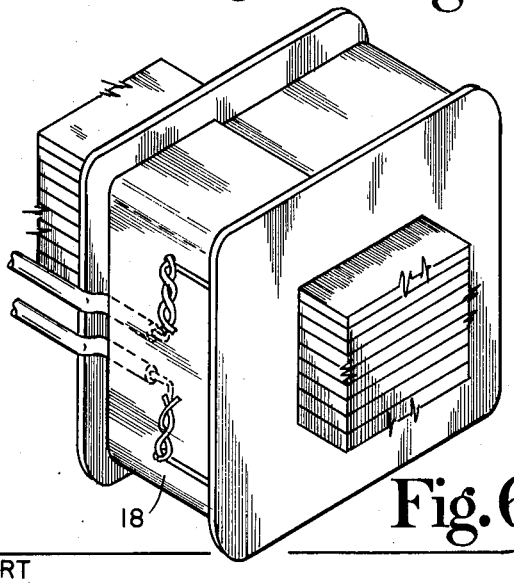
Fig. 6 PRIOR ART
FIG. 6 is a perspective view showing a still further step in the procedure.
Figure 7:
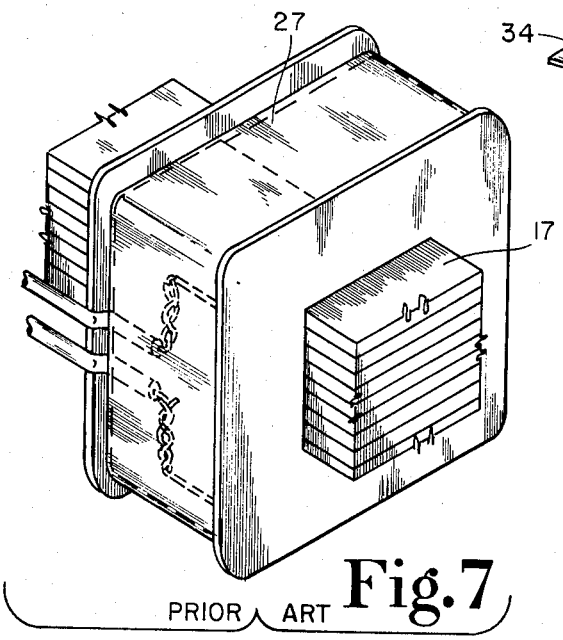
FIG. 7 is a perspective view showing a final step in the prior art procedure.

The next step in the prior art procedure is to bring the ends 12A and 12B of the coil winding wire into engagement with the lead wires 21A and 22A and twist them together as shown in FIG. 5. Then they are dipped in a solder pot to solder the wires together. Then they are folded back down on to the top of the strip 18 as shown in FIG. 6. Then the assembly is wrapped with four turns of tape 27. This provides both the electrical insulation needed between the soldered connections and the outside, and also minimizes the likelihood of the tape being punctured either by the soldered connection or by some external force which may be inadvertently applied to the coil assembly.

The foregoing has described a typical prior art procedure which is followed by at least one coil manufacturer. A slightly different one used by another coil manufacturer does not use the apertured strip 18 but, instead, uses a treated paper strip instead of the Mylar strip 18, and staples the lead wires to that strip. Otherwise the procedure is essentially the same.

DESCRIPTION OF THE PREFERRED EMBODIMENT OF THE PRESENT INVENTION

Figure 8:
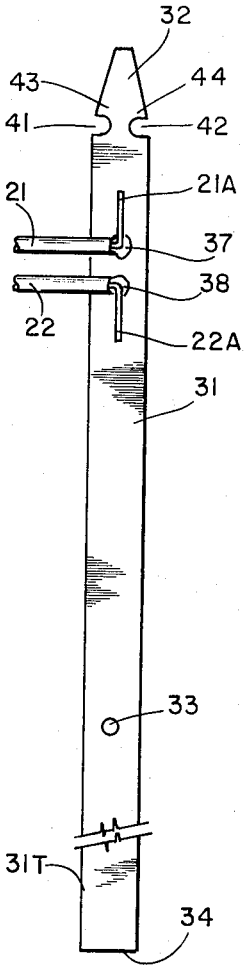
FIG. 8 is a face view of a harness device according to a typical embodiment of the present invention.
Figure 9:
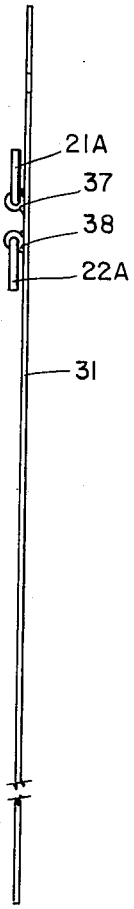
FIG. 9 is an edge view thereof.

Referring now to FIGS. 8 and 9, according to a typical embodiment of my invention, a different harness means and method are employed. The harness means includes a lead support strip 31 (FIGS. 8 and 9) made of a flexible dielectric material preferably having some resilience to it. An example of a very satisfactory material is made of polyvinyl chloride which is 0.020 inches thick and normally referred to as "dry vinyl strip No. PP637" as manufactured by Columbus Coated Fabrics Division of the Borden Company, of Columbus, Ohio. This strip has a point or arrowhead end 32, an aperture therein 33 at substantial distance from the point when compared to the width of the strip, and a tailend 34 at a substantial distance longitudinally from the aperture 33, although the distance from aperture 33 to the point is usually somewhat greater than the distance of the tailend from aperture 33. Leads 21 and 22 may be of the same kind and material as used in prior art, but one difference according to the present invention is the fact that the insulation thereof is welded to the strip 31 at 37 and 38 by some heat generating spot welding techniques such as high frequency electrical or ultrasonic welding. The wires 21A and 22A thereof are turned or bent to extend parallel to the length of the strip and in opposite directions, one of them toward the point 32 and the other toward the tail 34.

Figure 10:
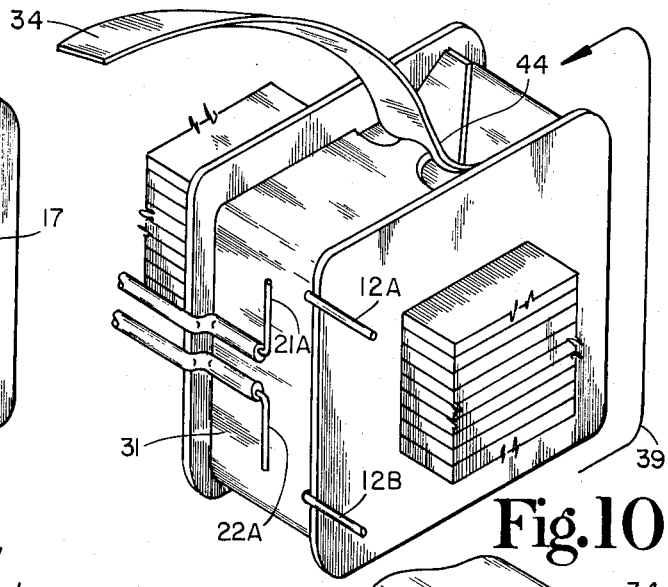
FIG. 10 is a perspective view of electromagnetic coil assembly being prepared according to a typical embodiment of the present invention.

The harness of FIGS. 8 and 9 is then mounted to the coil assembly 11 of FIG. 1, by placing the base strip 31 on top of the tape 16 and pulling the tail around the coil in the looping direction of the arrow 39 in FIG. 10. Then, when the aperture 33 of the strip is adjacent the point 32, the point 32 is inserted through the aperture and the point and tail may be manipulated as needed to pull the point 32 entirely through the aperture 33 until the notches 41 and 42 in side edges of the strip 31 reach the aperture 33, whereupon the shoulders 43 and 44 of the arrowhead which will have folded toward the axis of the strip while pulling the head or point through the aperture 33, will resiliently return to the position shown in FIGS. 8, 9 and 10 to lock against the strip 31 opposite sides of the aperture 33 and thereby secure the base strip 31 to the coil assembly. The distance between the point base shoulders and aperture 33 is selected so that when wrapped on the coil of the size to be assembled, there will be slight stretching longitudinally of the strip and therefore there will remain some stretch in the strip when the latching has been secured as shown in FIG. 10. Therefore, due to the residual stress or tension in the strip, it will remain snuggly secured to the coil assembly and will not slip either laterially or longitudinally of the strip. The tail portion of the strip remains free as shown in FIG. 10.

Figure 11:
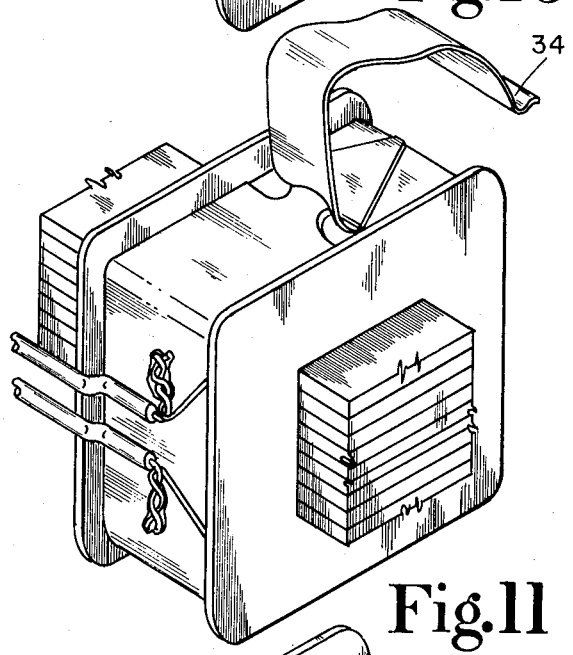
FIG. 11 illustrates the step where the coil wire end and lead wires have been twisted together and laid down against the harness strip.

The next step is to twist the lead wires 21A and 22A together with the coil winding wire ends 12A and 12B, dip them in solder, allow them to cool and then lay them down on the outer face of the strip 31 as shown in FIG. 11.

Figure 12:
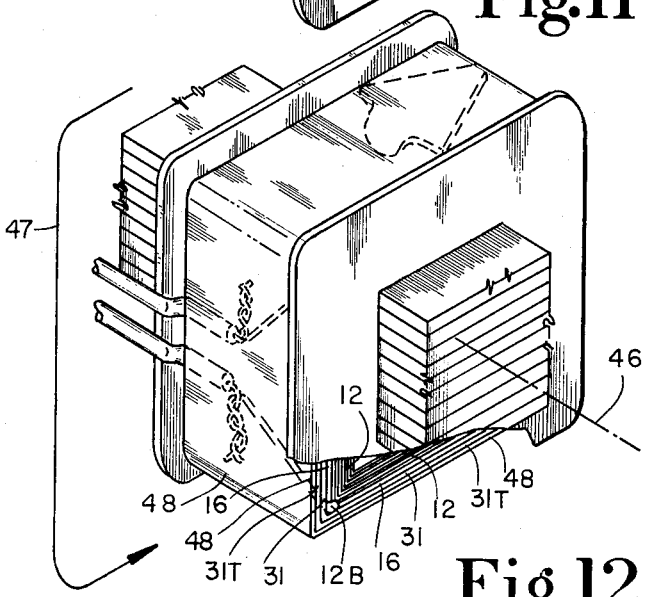
FIG. 12 is a perspective view of a further step in the procedure.

The next step is to bring the tail 37 of the strip around in the same direction as it was brought toward the point before insertion of the point through the aperture, and continue on around the coil untl the tail lays flat against that portion of the base strip which is already snug around the coil. This will occur as shown in FIG. 12 where the tailend portion 34 is almost diametrically opposite the point with respect to the axis 46 of the core. This movement of the tailend of the strip is represented by the arrow 47 in FIG. 12. It will be observed that, as this is done, the exposed soldered ends of the wires are covered by the tail portion of the strip 31. While this is adequate coverage both from the standpoint of electrical insulation, and mechanical protection, it might be considered desirable in some instances to tape the tailend down to the rest of the strip. In the illustrated embodiment of FIG. 12, this is done by applying a complete circle of tape 48 around the outside of the assembly. At the same time, this also holds the point down flat against the strip 31 as shown in FIG. 12. Tape 48 can be conventional electrical or non-electrical tape with a pressure-sensitive adhesive backing.

Referring now to FIGS. 13 and 14, showing an alternate embodiment of the invention, the strip 51 is essentially the same as strip 31 of the preceding figures, having a point 52 and an aperture 53 and a tailend 54, but it is much longer from the point to the tailend, and has a second aperture 56 therein. The distance between the second aperture 56 and first aperture 53 is essentially the same as the distance between the point base notches 57 and the first aperture 53.

For the second embodiment of the invention, the procedure is the same as described above for the first embodiment until the last wrapping with the tape 48 in the first embodiment. Instead of that, a tailend is brought around in the direction of the arrow 59 in the same way as was done with the tailend in the direction of arrow 47 in FIG. 12. However, in this instance, the point 52 is pulled through the second aperture 56 and the point latching lug portions 61 and 62 are latched against the strip 51 at the locations 63 and 64, respectively, at each side of the aperture 56. In this embodiment, even without the added tape 48 of FIG. 12, there is no possibility that the soldered connections will become uncovered. Also, since the projecting ends (the point 52 and tail portion 51T) are comparatively short, there is essentially no likelihood that they would cause any interference with any other assemblies with which the coil would be used. If it is nevertheless desired to secure them flat against the outer face of the strip 51T, they can be fastened down by attaching a short piece of any kind of tape having a pressure sensitive adhesive backing such as the short strip of tape 66 overlying the point 52 and tailend portion 51T in FIG. 16.

From the foregoing description, it should be recognized that the present invention provides means and a method for quick attachment of external leads to a coil assembly, reducing usage of tape, shielding the soldered connections from any contact with adhesive material to thereby reduce corrosion, and increase durability of the whole assembly.

While the invention has been illustrated and described in detail in the drawings and foregoing description, the same is to be considered as illustrative and not restrictive in character, it being understood that only the preferred embodiments have been shown and described and that all changes and modifications that come within the spirit of the invention are desired to be protected.

What is claimed:

1. Electric coil lead attachment means comprising:

an elongate strip of resilient material having first latching means adjacent one end and second latching means longitudinally spaced from said first latching means and co-operable with said first latching means to secure said strip in a loop configuration;

and at least a first electric lead fastened to said strip at a point and disposed entirely on one face of said strip, an insulated portion of said lead extending away from said strip, and a non-insulated portion of said lead extending parallel to the face of said strip from said point and immediately adjacent said face.

2. The attachment means of claim 1 wherein the material is polyvinyl chloride less than 0.030 inch thick.

3. The attachment means of claim 1 wherein:

said one end is generally pointed, with said first latching means including at least one shoulder, the shoulder and pointed end establishing a pointed head on the strip; and said second latching means is an aperture in said strip, said aperture being of a size such that its largest dimension is less than the dimension transverse to said strip at said shoulder, whereby said head must be deformed at said shoulder to permit said head to pass through said aperture, pointed end first, the material being sufficiently resilient for said head to restore itself from its deformed state after passage through said aperture, whereby said shoulder is abuttingly engaged with said strip at said aperture to retain said head in latched state and maintain said strip in said loop configuration.

4. The attachment means of claim 3 wherein:

said strip is edge notched on opposite edges adjacent said pointed end to form an arrowhead shape at said pointed end.

5. The attachment means of claim 3 wherein:

said lead is fastened to said strip adjacent said head; and said strip has a tail portion extending from said aperture in a direction away from said head and for a distance greater than the distance from said head to said lead for insulating the non-insulated portion outboard of said face after connection to a coil lead and wrapping said tail portion over said non-insulated portion.

6. The attachment means of claim 4 and further comprising:

a second aperture in said strip, said second aperture being spaced longitudinally from said first aperture a distance substantially the same as the distance between said first aperture and said notches.

7. The attachment means of claim 5 or 6 and further comprising:

a second electric lead fastened to said strip;

each of said leads including an electrically insulated conductor and surrounding insulator, the leads being spaced in a plane containing said strip at the location of fastening to the strip, and the fastening of the leads to the strip being by attachment of the insulator to the strip so that the leads project transversely from the strip.

8. An electric coil assembly having a coil winding of a plurality of turns of coil wire between shoulders of a bobbin and having a layer of tape encircling the winding and retaining the coil wire in place between the bobbin shoulders;

an elongate strip of resilient material having first latching means adjacent one end and second latching means longitudinally spaced from said first latching means and co-operable with said first latching means to secure said strip in a loop configuration;

a first electric lead fastened to said strip at a point and disposed entirely on one face of said strip, an insulated portion of said lead extending away from said strip, and a non-insulated portion of said lead extending parallel to the face of said strip from said point and immediately adjacent said face, said one end of said strip being generally pointed, with said first latching means including at least one shoulder, the shoulder and pointed end establishing a pointed head on the strip, said second latching means being an aperture in said strip, said aperture being of a size such that its largest dimension is less than the dimension transverse to said strip at said shoulder, whereby said head must be deformed at said shoulder to permit said head to pass through said aperture, pointed end first, the material being sufficiently resilient for said head to restore itself from its deformed state after passage through said aperture, whereby said shoulder is abuttingly engaged with said strip at said aperture to retain said head in latched state and maintain said strip in said loop configuration, said lead being fastened to said strip at a point adjacent said head, said strip having a tail portion extending from said aperture in a direction away from said head and for a distance greater than the distance from said head to said lead for insulating the non-insulated portion outboard of said face after connection to a coil lead and wrapping said tail portion over said non-insulated portion, a second electric lead fastened to said strip, each of said leads including an electrically insulated conductor and surrounding insulator, the leads being spaced in a plane containing said strip at the points of fastening said leads to the strip, and the fastening of the leads to the strip being by attachment of the insulator to the one outside face of the strip so that the insulated portions of the leads project transversely from the strip, said strip being mounted on said tape layer with the inside face of the loop configuration of the strip encircling the tape layer snugly and resiliently, and the leads on the outside face of the strip, the lead conductors being attached to opposite ends of said coil wire to provide two lead connections, said lead connections being on the outside face of the strip and extending in opposite directions from the locations of fastening of the leads to the strip;

and the tail portion of the strip extending from the head in a second layer covering the said connections.

9. The combination of claim 8 and further comprising:

additional tape means covering at least a part of said second layer and assisting in urging at least a portion of said strip toward the said inside face.

* * * * *